US007864124B2

(12) United States Patent
Hong et al.

(10) Patent No.: US 7,864,124 B2
(45) Date of Patent: Jan. 4, 2011

(54) MULTI-BAND ANTENNA FOR MOBILE PHONE

(75) Inventors: Suk-Chan Hong, Gumi-si (KR); Jae-Kyu Lee, Gumi-si (KR); Jun-Chul Kang, Gumi-si (KR)

(73) Assignee: Samsung Electronics Co., Ltd (KR)

( * ) Notice: Subject to any disclaimer, the term of this patent is extended or adjusted under 35 U.S.C. 154(b) by 197 days.

(21) Appl. No.: 12/136,929

(22) Filed: Jun. 11, 2008

(65) Prior Publication Data

US 2009/0009407 A1 Jan. 8, 2009

(30) Foreign Application Priority Data

Jun. 11, 2007 (KR) ..... 10-2007-0056677

(51) Int. Cl.
*H01Q 1/24* (2006.01)

(52) U.S. Cl. ..... 343/702; 343/850

(58) Field of Classification Search ..... 343/700 MS, 343/702, 850, 853, 860
See application file for complete search history.

(56) References Cited

U.S. PATENT DOCUMENTS

| | | | | |
|---|---|---|---|---|
| 7,084,831 | B2 * | 8/2006 | Takagi et al. | 343/860 |
| 7,161,543 | B2 * | 1/2007 | Cheng et al. | 343/702 |
| 7,433,725 | B2 * | 10/2008 | Lin et al. | 455/575.7 |
| 7,495,620 | B2 * | 2/2009 | Wang et al. | 343/702 |
| 7,554,495 | B2 * | 6/2009 | Enoshima et al. | 343/702 |
| 2008/0143607 | A1 * | 6/2008 | Jung et al. | 343/700 MS |
| 2009/0040109 | A1 * | 2/2009 | Iguchi et al. | 343/700 MS |

* cited by examiner

*Primary Examiner*—Hoang V Nguyen
(74) *Attorney, Agent, or Firm*—The Farrell Law Firm, LLP

(57) ABSTRACT

A mobile phone includes a multi-band antenna which is mutually connected in a dependent manner for operation according to a signal transmitted to and received from the mobile phone; and a resonance unit for generating resonance for multiple frequency bands as ends of the multi-band antenna are spaced apart at a predetermined interval, to improve mute performance, reduce SAR, and prevent a reduction in call performance due to an influence of a user's body and hand when holding the mobile phone to make a call.

6 Claims, 8 Drawing Sheets

MULTI-BAND ANTENNA FOR MOBILE PHONE

PRIORITY

This application claims priority under 35 U.S.C. §119(a) to a Korean Patent Application filed in the Korean Intellectual Property Office on Jun. 11, 2007 and assigned Serial No. 2007-56677, the disclosure of which is incorporated herein by reference.

BACKGROUND OF THE INVENTION

1. Field of the Invention

The present invention relates to an antenna for communication, and, in particular, to a multi-band antenna which is applied to a terminal such as a mobile phone.

2. Description of the Related Art

With the recent rapid development of mobile communication and satellite communication technologies, there is an increasing importance of wireless communication in information society. Wireless communication technology, which originated from voice-oriented narrow-band communication, is rapidly developing into broadband communication for Internet, multimedia, etc.

Commercialization of new wireless services, such as $4^{th}$ generation mobile communication based on IMT-2000 and high-speed mobile communication, is close at hand. Antenna technology is a major technology that forms the basis of wireless communication, and the importance of antenna technology increases daily since a mobile phone's antenna performance is a factor that determines communication quality.

As provision of various services in numerous fields, such as cellular mobile communication, Personal Communications Service (PCS), satellite mobile communication, etc. is possible as various communication services develop, intensive research is being conducted on wireless access schemes, and power/interference control, as well as terminal and network system technology for realization of miniaturization and reduction in weight of communication equipment for terminals and base stations.

An increasing popularization of mobile phones capable of providing the various services continues to bring new terminals with various functions and designs.

The recent trend in mobile phones is that consumers prefer, rather than bar type terminals, folder type or flip-up type terminals having a main body and a sub-body. The sub-body, also referred to as a folder, is mounted on the main body so that it can be opened and closed at a predetermined angle via a hinge module.

The folder type terminal has an advantage in that when its sub-body (including flip cover or folder) is coupled to the main body, the multiple key buttons formed on the main body are protected to prevent misoperation of the device. When open, the folder serves as a sound reflection plate during a call to concentrate the voice on a certain point. In addition, a wide Liquid Crystal Display (LCD) module can be individually mounted on the folder module of the folder type terminal, allowing the terminal to be miniaturized while providing a variety of functions.

Normally, a hinge module for opening and closing the sub-body on the main body at a predetermined angle is mounted in the folder type terminal. The hinge module serves not only to define a predetermined opening/closing angle of the sub-body, but also to store a predetermined elasticity when it is folded, so as to prevent the folder from being arbitrarily opened.

In addition to the demand for smaller, lighter and thinner terminals, there is a demand for terminals that provide a variety of functions. In order to meet such consumer demands, emphasis is placed laid on reducing the size or volume of the terminals if possible while maintaining or improving the functions.

In addition to the demand for smaller and lighter weight terminals that maximize the variety of functions, there is an increasing demand for convenience. To meet the demands, terminal makers concentrate their efforts on removing the various inconvenience aspects that may occur during use of the mobile phones.

Due to such problems, multi-band mobile phones, which support more than two frequency bands to enable both the old services and new services, are becoming increasingly more popular.

Therefore, antennas for the mobile phones are also developing into multi-band antennas supporting more than one frequency band. For example, generally, Code Division Multiple Access (CDMA) operates in a frequency band of 824 MHz~894 MHz, while PCS operates in a frequency band of 1850 MHz~1990 MHz. As one mobile phone can support both the CDMA band and the PCS band, dual-band antennas have been developed that can support both 824 MHz~894 MHz and 1850 MHz~1990 MHz frequency bands.

Recently, there is an increasing need for triple-band antennas supporting CDMA/PCS/GPS bands including a Global Positioning System (GPS) band of 1574 MHz~1576 MHz. Accordingly, multi-band antennas are provided to extend the upper and/or lower bands of the existing single/dual-band antennas. Recently, in order to provide fine designs of mobile phones that are convenient to use, internal antennas rather than external antennas are popularly used.

For example, an internal antenna ('Intenna') chiefly used for a mobile phone can be classified into Planar Inverted F Antenna (PIFA) type, Loop type, and Monopole type.

FIGS. 1A and 1B are perspective views illustrating an internal antenna applied to the conventional mobile phone. Referring to FIG. 1A, the general internal antenna is mostly situated in an upper end of the mobile phone. Although the position of the internal antenna is subject to slight change according to the internal structure of the mobile phone, the internal antenna is formed on the upper end in most cases, to maximize antenna performance.

FIG. 1B provides an example of a PIFA/Loop type Intenna that includes an Intenna patch, a feeding port 101 connected to the Intenna patch and a ground port 102.

The PIFA Intenna should be designed to provide antenna characteristics best suited for a particular terminal. In this case, the antenna device is designed taking into account fixed design parameters and variable design parameters. Regarding the fixed design parameters, a length and width of a radiator, and a spaced distance between a ground surface and the radiator are roughly determined according to the predetermined shape and size of the terminal.

Therefore, the best antenna characteristics can be found by changing the variable design parameters during antenna characteristic matching. The variable design parameters can include a position of a feeding pin, a width of the feeding pin and a ground pin, a spaced distance between the feeding pin and the ground pin, a shape of a pattern formed on the radiator, etc.

Since the antenna applied to the conventional mobile phone is realized in a single pattern regardless of its frequency mode, i.e., regardless of whether its frequency mode is a single-band mode or a multi-band mode, each band individually suffers from a reduction not only in mute performance but also in antenna radiation characteristics. In order to solve the problems, antenna gain may be increased to improve the mute performance, which, however, causes an increase in Specific Absorption Rate (SAR) as a side effect.

SUMMARY OF THE INVENTION

An aspect of the present invention is to address at least the problems and/or disadvantages and to provide at least the advantages described below. Accordingly, an aspect of the present invention is to provide a multi-band antenna which is mutually connected to operate according to a signal transmitted and received at a mobile phone, and resonates at multiple frequency bands to which it desires to be electrically coupled, thereby improving mute performance and reducing a Specific Absorption Rate (SAR).

Another aspect of the present invention is to prevent a decrease in call performance due to an influence of a human body and/or user's hand during a call with a mobile phone.

According to one aspect of the present invention, there is provided a mobile phone including a multi-band antenna which is mutually connected in a dependent manner so as to operate according to a signal transmitted to/received from the mobile phone; and a resonance unit for generating resonance for a plurality of frequency bands as ends of the multi-band antenna are spaced apart at a predetermined interval.

BRIEF DESCRIPTION OF THE DRAWINGS

The above and other aspects, features and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will now be described in detail with reference to the annexed drawings. In the following description, a detailed description of known functions and configurations incorporated herein has been omitted for clarity and conciseness.

Figure 1A:
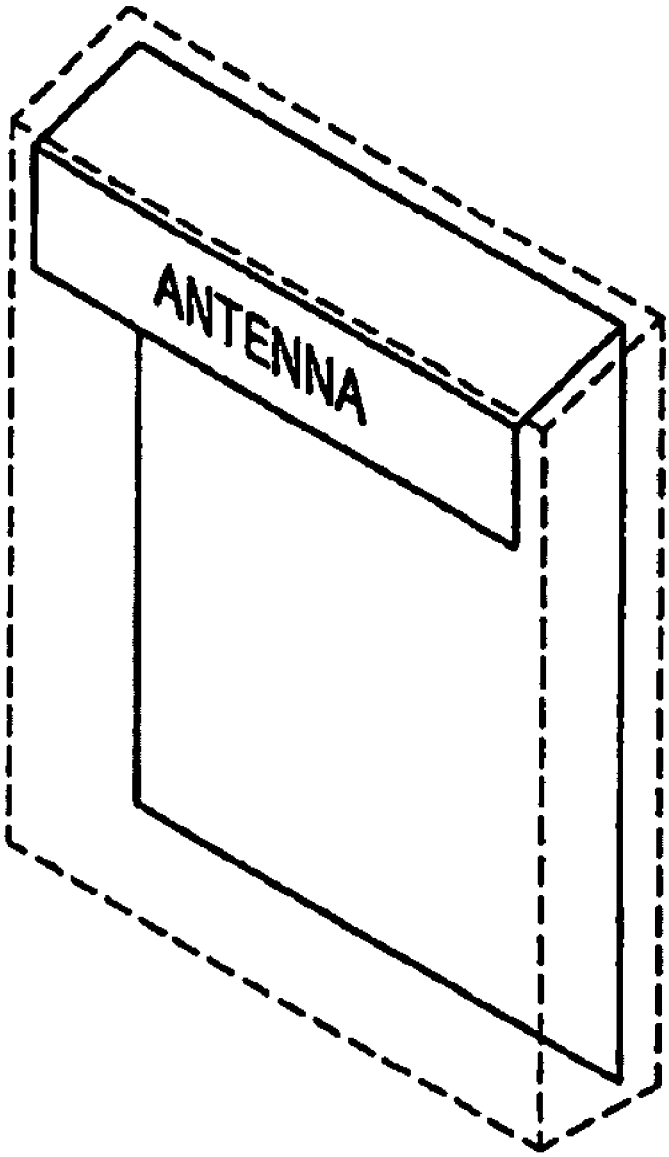
FIGS. 1A and 1B are perspective views illustrating a conventional internal antenna to be applied to a mobile phone.
Figure 1B:
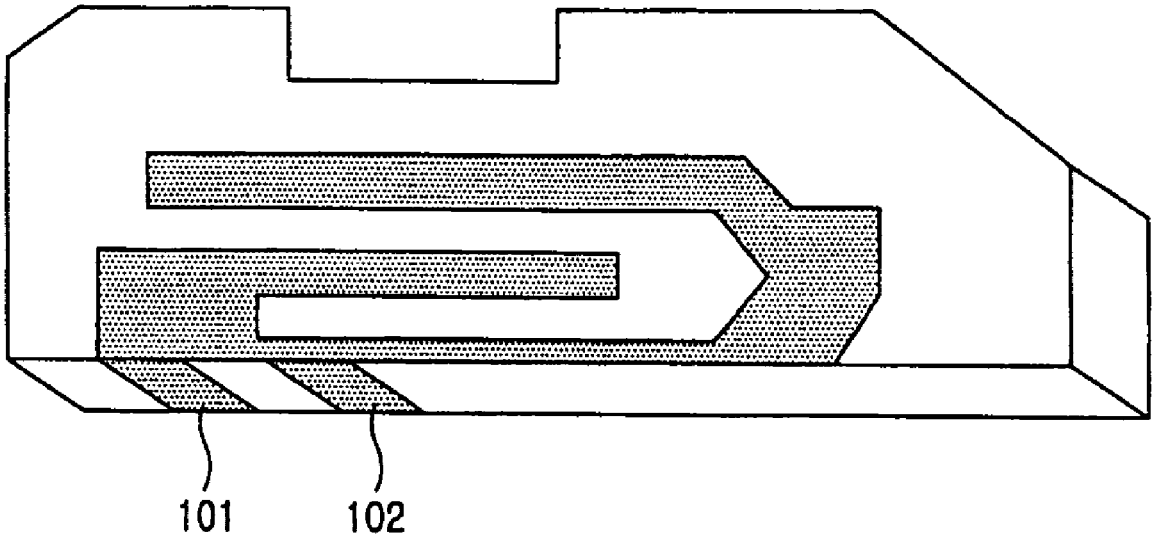
Figure 2A:
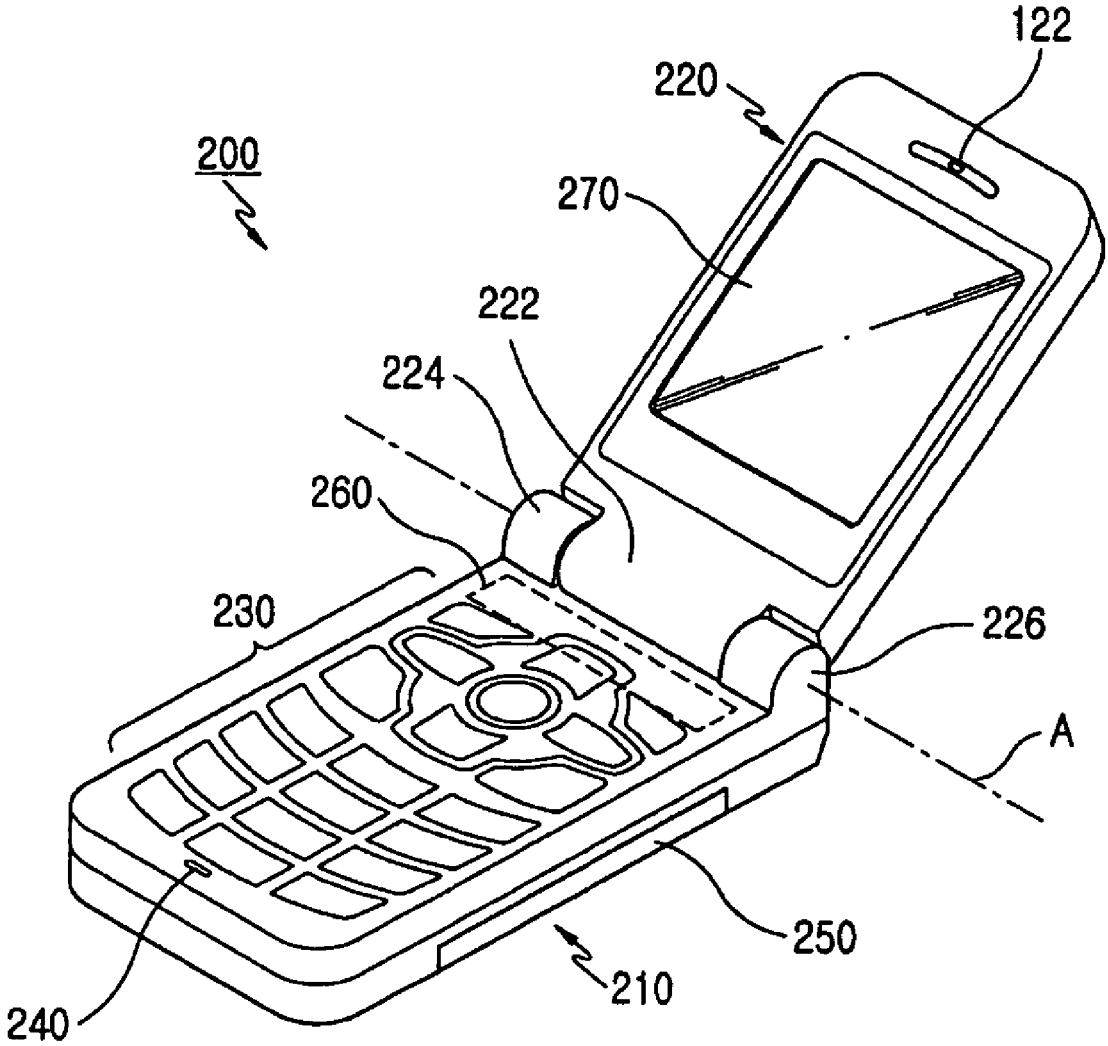
FIGS. 2A and 2B are perspective views illustrating a folder-type mobile phone with a multi-band antenna according to a preferred embodiment of the present invention.
Figure 2B:
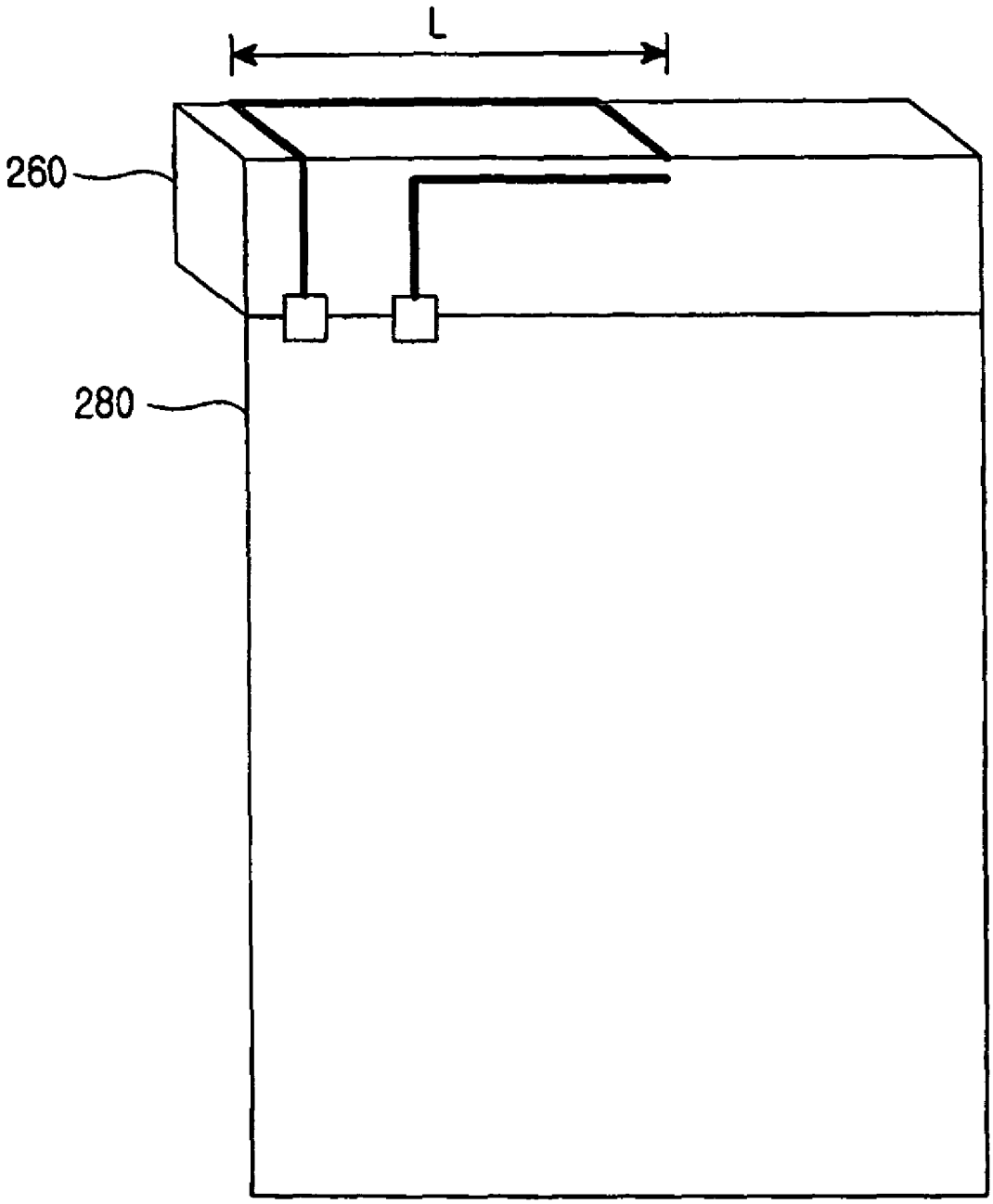

FIGS. 2A and 2B are perspective views illustrating a folder-type mobile phone with a multi-band antenna according to a preferred embodiment of the present invention. Referring to FIG. 2A, a mobile phone 200 according to the present invention includes a main body 210, and a folder 220, which is coupled to an upper end of the main body 210 through a hinge so that the folder 220 can rotate about the center of the hinge with respect to the main body 210.

A plurality of keys 230 for inputting a variety of information and a mouthpiece 240 for picking up a user's voice are provided on the front of the main body 210, and a battery 250 is detachably coupled to the rear of the main body 210. A multi-band antenna 260 is mounted in an upper end of the main body 210.

Although the multi-band antenna 260 can be a predetermined pattern type conductor having a pattern with a length and interval corresponding to its desired Global Systems for Mobile communication (GSM) frequency band and Digital Cordless System (DCS) frequency band, it is not limited thereto, and antenna radiators in various shapes can be mounted therein.

The folder 220 is folded on the main body 210 along rotation axis "A". A center hinge arm 222 is formed on the folder 220, and side hinge arms 224 and 226 are formed on both sides of the main body 210 so that they face each other.

The center hinge arm 222 includes therein a hinge module, a part of which is fixed to the side hinge arms 224 and 226 in an engaged manner, thereby providing an opening/closing feeling of the folder 220 to the user and guiding a direction change toward an opening/closing direction at a predetermined time during operation of the folder 220.

A display device 270 for outputting specific video information is mounted on the front of the folder 220, and an earpiece 122, with which the user can receive voices from the other party, is also provided on the front of the folder 220.

Referring to FIG. 2B, a main board 280 is mounted in the main body 210 so that it can receive a variety of information and can control communication based thereon. The multi-band antenna 260 is mounted on an upper end of the main board 280 and electrically connected thereto.

Although not illustrated, a wireless transmission/reception circuit is formed on a predetermined region of the main board 280. The wireless transmission/reception circuit serves to transmit/receive signals in multiple frequency bands, for example, a GSM frequency band of 880~960 MHz, a DCS frequency band of 1.71~1.88 GHz, a Personal Communications Service (PCS) frequency band of 1.85~1.99 GHz, etc.

The wireless transmission/reception circuit transmits a signal in the GSM frequency band and/or the DCS frequency band, output from the mobile phone 200, to the multi-band antenna 260, or transmits a signal in the GSM frequency band and/or the DCS frequency band, received via the multi-band antenna 260, to the mobile phone 200.

The wireless transmission/reception circuit, having a separate switching device mounted therein, allows the multi-band antenna 260 to selectively operate according to the signal in the GSM frequency band or DCS frequency band, and when the mobile phone 200 is in a call mode, the wireless transmission/reception circuit reduces a Specific Absorption Rate (SAR) by increasing the mute performance over the reception sensitivity of the multi-band antenna 260 since the mobile phone 200 is situated close to the body of the user.

Figure 3A:
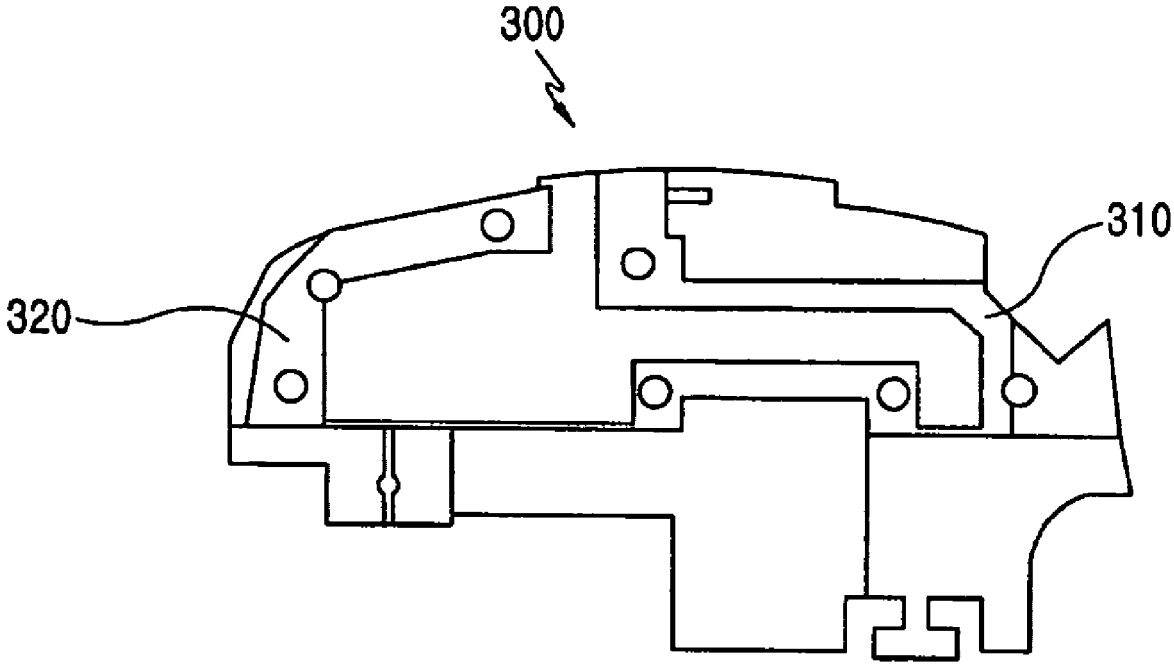
FIGS. 3A to 3C are diagrams illustrating an internal structure of a multi-band antenna according to a preferred embodiment of the present invention.
Figure 3B:
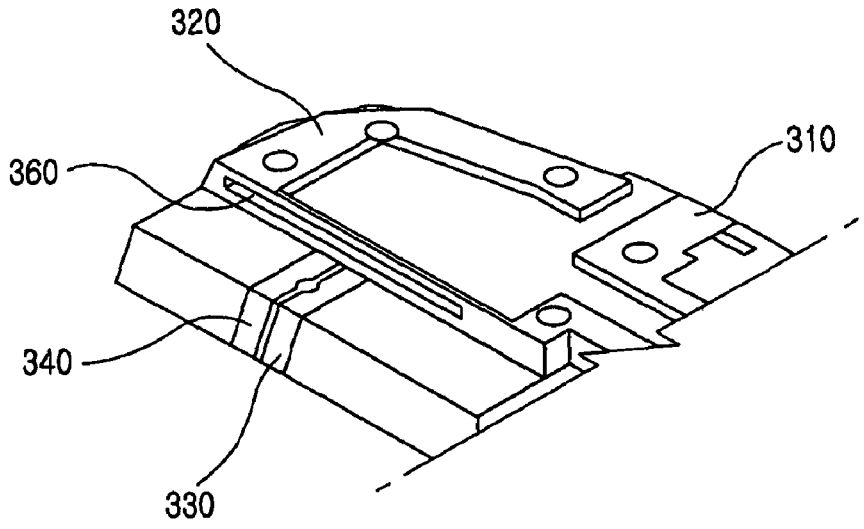
Figure 3C:
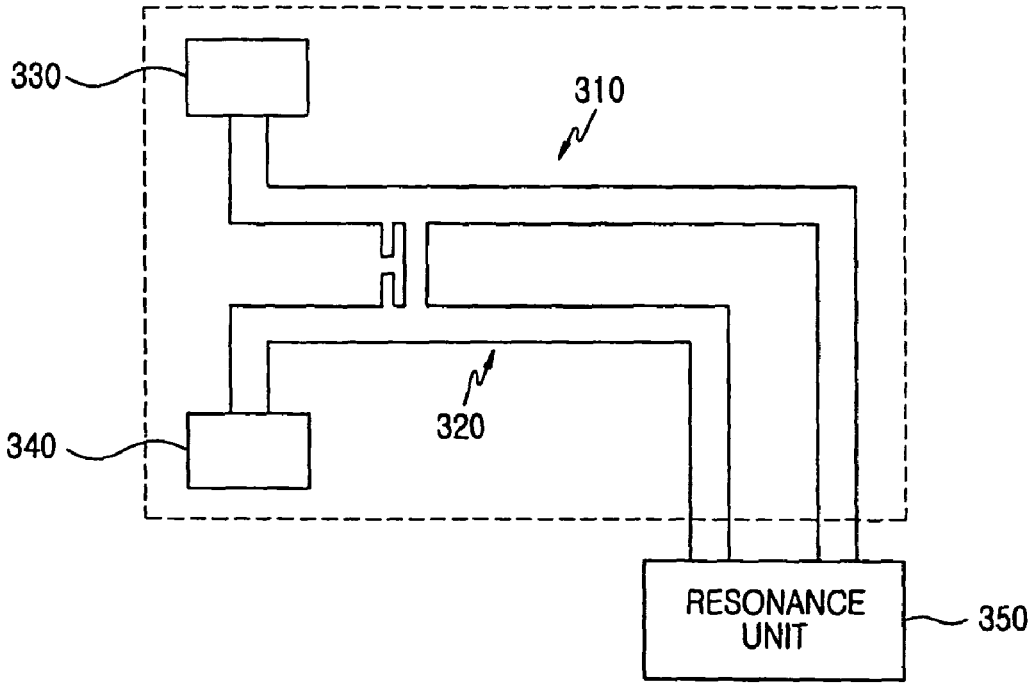
Figure 4A:
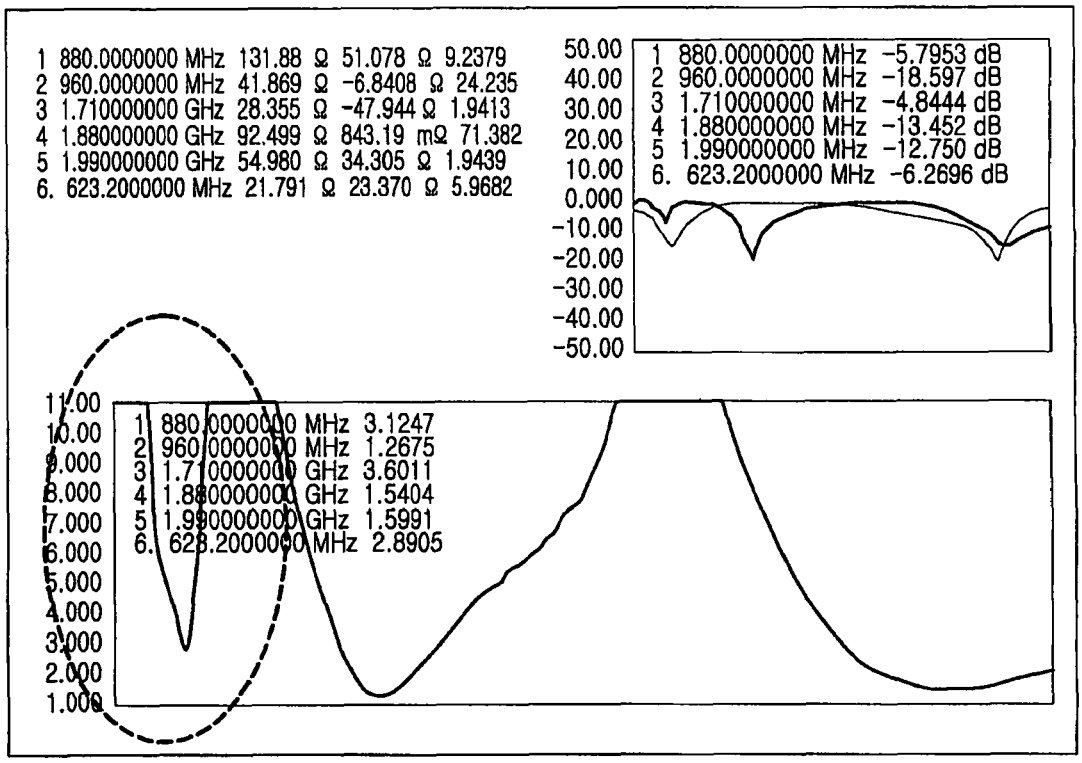
FIGS. 4A and 4B are graphs illustrating a Standing Wave Ratio (SWR) of a multi-band antenna according to a preferred embodiment of the present invention.
Figure 4B:
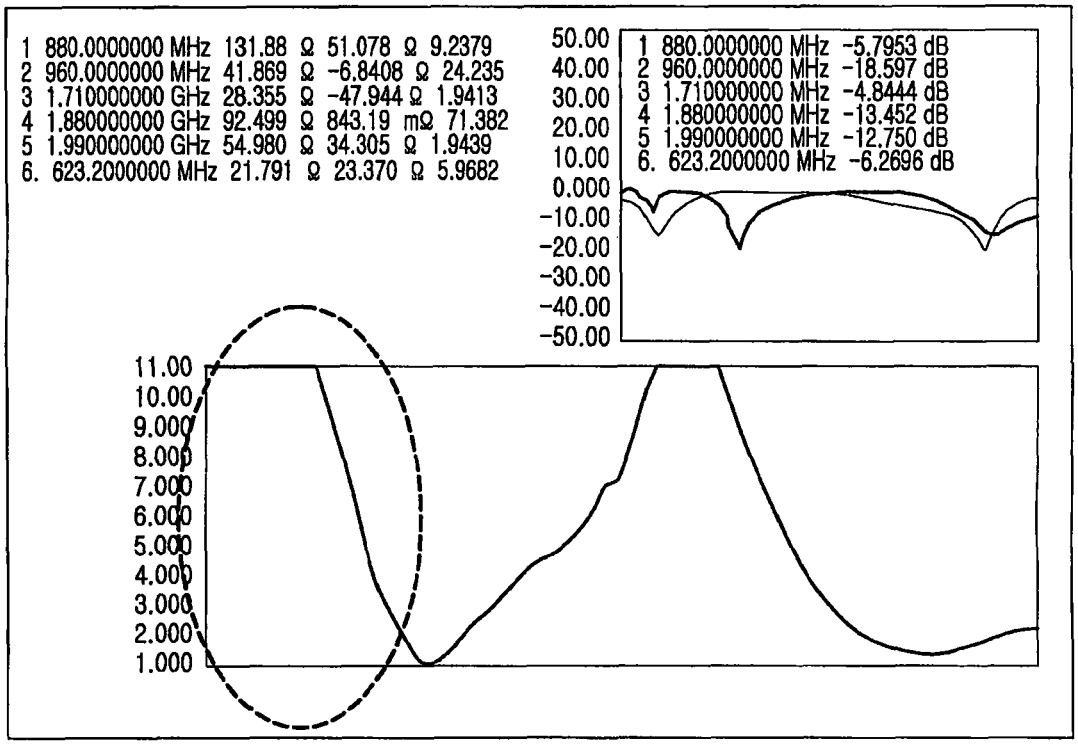

FIGS. 3A to 3C are diagrams illustrating an internal structure of a multi-band antenna according to a preferred embodiment of the present invention, and FIGS. 4A and 4B are graphs illustrating a Standing Wave Ratio (SWR) of a multi-band antenna according to a preferred embodiment of the present invention.

Referring to FIGS. 3A to 3C, the multi-band antenna 260 includes an elementary body 300 having a permittivity, and two feeding ports for feeding signals to a first antenna 310 and a second antenna 320, respectively.

The elementary body 300 serves as a body where an antenna pattern is formed with a dielectric material having multiple different faces, i.e. a plurality of faces, and can be a predetermined dielectric substance. However, the elementary body 300 is not limited to the foregoing, and dielectric substances of various shapes can be mounted thereon.

The first antenna 310 has a first feeding port 330 (FIG. 3B), which is formed on the bottom of the elementary body 300 to feed a signal transmitted to/received from the mobile phone 200, and is formed in a pattern with a length corresponding to the DCS frequency band so that the first antenna 310 is curved along multiple different faces of the elementary body 300 starting from the first feeding port 330.

The second antenna 320 is coupled to the first feeding port 330 in a predetermined distance in a dependent manner so that the first and second antennas 310, 320 are adjacent to each other. The second antenna 320 has a second feeding port 340 for feeding a signal transmitted to/received from the mobile phone 200, and is formed in a pattern with a length corresponding to the GSM frequency band so that the second antenna 320 is symmetrical to the first antenna 310 starting from the second feeding port 340.

Further, a resonance unit 350 (FIG. 3C) for generating resonance for each frequency band is provided as ends of the first antenna 310 and the second antenna 320 are spaced apart from each other at a predetermined interval (for example, 2 mm~7 mm).

As the first antenna 310 and the second antenna 320 are electrically coupled to each other by the signals fed from the first feeding port 330 and the second feeding port 340, the multi-band antenna 260 can generate resonance for its desired GSM frequency band and DCS frequency band, thereby improving mute performance and reducing SAR.

In addition, as shown in FIG. 3B, the multi-band antenna 260 has a lateral (horizontal) slot 360 formed at a connection point of the first and second feeding ports 330 and 340, to remove parasitic resonance from an undesired frequency band according to the size of the slot 360. That is, as a result of measuring SWR over the band of 500 MHz~2.1 GHz in the state where the slot 360 is formed in the multi-band antenna 260, it can be appreciated from FIGS. 4A and 4B that the measured SWR shows an excellent return loss characteristic as parasitic resonance is removed from the 630-MHz frequency band.

Figure 5:
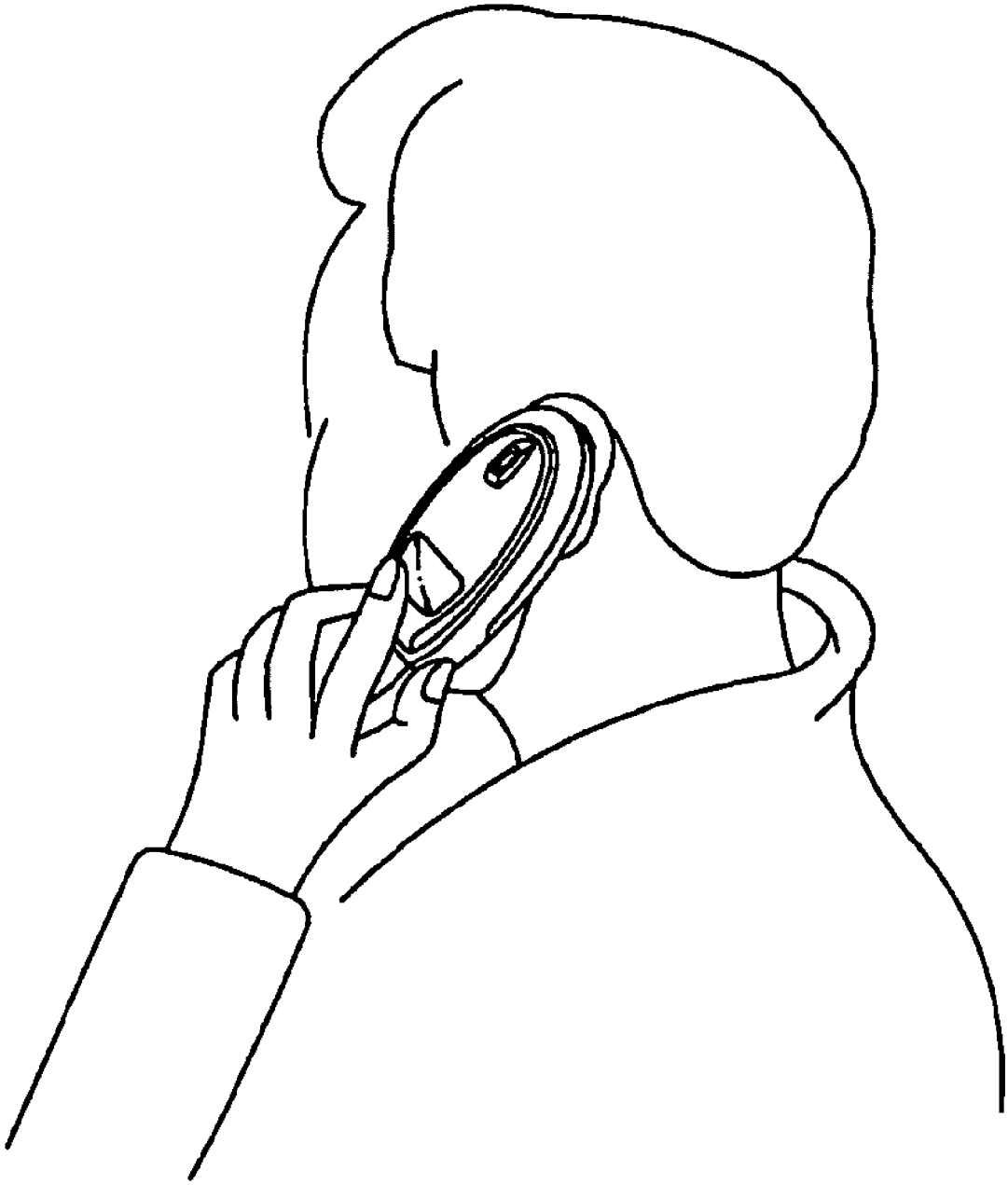
FIG. 5 is a diagram illustrating a state in which the front and side of a folder type mobile phone with a multi-band antenna is used according to a preferred embodiment of the present invention.

FIG. 5 is a diagram illustrating a state in which the front and side of a folder type mobile phone with a multi-band antenna is used according to a preferred embodiment of the present invention. Referring to FIG. 5, as the mobile phone 200 performs a call utilizing the multi-band antenna 260 embedded in an upper end of the main body 210, the user, during the call, holds the mobile phone 200 in a wrapping-up fashion and supports the resonance unit 350 of the multi-band antenna 260 with his/her fingers so that the mobile phone 200 may not drop down, thereby further improving the mute performance and thus preventing a reduction in call performance due to an influence of the body and hand of the user.

Table 1 shows a comparison in simulation results on a mute performance between the folder type mobile phone 200 with the proposed multi-band antenna 260 and the folder type mobile phone 200 with the conventional internal antenna based on the GSM frequency band and the DCS frequency band. It can be appreciated from Table 1 that the folder type mobile phone 200 with the proposed multi-band antenna 260 shows an excellent mute rate performance for conversation.

TABLE 1

| Frequency band | GSM band | | DCS band | |
|---|---|---|---|---|
| Classified | Invention | Conventional | Invention | Conventional |
| Tx Mute Rate | 4/80 = 5.0% | 11/80 = 13.75% | 1/80 = 1.25% | 20/80 = 25% |
| Rx Mute Rate | 4/80 = 5.0% | 5/80 = 6.25% | 6/80 = 7.5% | 7/80 = 8.75% |

Table 2 shows a comparison in the simulation result on a transmission/reception rate between the folder type mobile phone 200 with the multi-band antenna 260 of the present invention and a folder type mobile phone 200 with the conventional internal antenna based on the GSM frequency band. Table 3 shows a comparison in the simulation result on a transmission/reception rate between the folder type mobile phone 200 with the multi-band antenna 260 of the present invention and a folder type mobile phone 200 with the conventional internal antenna based on the DCS frequency band.

TABLE 2

| Frequency band | GSM band | | | |
|---|---|---|---|---|
| Classified | Invention | | Conventional | |
| Sample number | #1 | #2 | #1 | #2 |
| Tx success | 18/20 = 90% | 18/20 = 90% | 17/20 = 85% | 18/20 = 90% |
| Rx success | 15/20 = 75% | 18/20 = 90% | 12/20 = 60% | 12/20 = 60% |

TABLE 2-continued

| Frequency band | GSM band | | | |
|---|---|---|---|---|
| Classified | Invention | | Conventional | |
| Sample number | #1 | #2 | #1 | #2 |
| Tx Total | 36/40 = 90% | | 35/40 = 87.5% | |
| Rx Total | 33/40 = 82.5% | | 24/40 = 60% | |
| Possible Tx rate | 20/20 = 100% | 20/20 = 100% | 20/20 = 100% | 20/20 = 100% |

TABLE 3

| Frequency band | DCS band | | | |
|---|---|---|---|---|
| Classified | Invention | | Conventional | |
| Sample number | #1 | #2 | #1 | #2 |
| Tx success | 20/20 = 100% | 20/20 = 100% | 16/20 = 80% | 20/20 = 100% |
| Rx success | 19/20 = 95% | 20/20 = 100% | 17/20 = 85% | 19/20 = 95% |
| Tx Total | 40/40 = 100% | | 36/40 = 90% | |
| Rx Total | 39/40 = 97.5% | | 36/40 = 90% | |
| Possible Tx rate | 20/20 = 100% | 20/20 = 100% | 20/20 = 100% | 20/20 = 100% |

As is apparent from the foregoing description, the present invention generates resonance for desired multiple frequency bands electrically coupled from a multi-band antenna which is mutually, i.e. electrically and dependently, connected to operate according to the signal transmitted to/received from the mobile phone, thereby improving mute performance, reducing SAR, and preventing a reduction in call performance due to an influence of the body and hand of the user during a call with the mobile phone.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A mobile phone comprising:

a multi-band antenna in which at least two antennas are mutually connected in a dependent manner so as to operate according to a signal transmitted and received to/from the mobile phone; and a resonance unit for generating resonance for a plurality of frequency bands as ends of the at least two antennas in the multi-band antenna are spaced apart at a predetermined interval.

2. The mobile phone of claim 1, wherein the multi-band antenna further comprises:

an elementary body with multiple different faces, having a permittivity;

a first feeding port formed on a bottom of the elementary body, for feeding a signal transmitted and received to/from the mobile phone;

a first antenna which is formed in a pattern with a length corresponding to a first frequency band, curved along the multiple different faces of the elementary body starting from the first feeding port;

a second feeding port connected to the first feeding port, for feeding a signal transmitted and received to/from the mobile phone; and a second antenna formed in a pattern with a length corresponding to a second frequency band, symmetrical to the first antenna starting from the second feeding port.

3. The mobile phone of claim 2, wherein the second feeding port is coupled to the first feeding port in a predetermined distance in a dependent manner so that they are adjacent to each other.

4. The mobile phone of claim 2, wherein the first antenna and the second antenna are electrically coupled to each other to generate resonance in multiple frequency bands.

5. The mobile phone of claim 4, wherein at least one of multiple frequency bands comprise a Global Systems for Mobile communication (GSM) frequency band and a Digital Cordless System (DCS) frequency band.

6. The mobile phone of claim 1, wherein a slot is formed on a portion to which a first feeding port and a second feeding port for feeding a signal transmitted and received to/from the mobile phone are connected, to remove parasitic resonance from an undesired frequency band according to a size of the slot.

* * * * *